United States Patent [19]

Puskarz

[11] 4,363,339

[45] Dec. 14, 1982

[54] FILLING VALVE ARRANGEMENT FOR COUNTER-PRESSURE CONTAINER FILLING APPARATUS

[75] Inventor: Stanley J. Puskarz, Clearwater, Fla.

[73] Assignee: Barry-Wehmiller Company, St. Louis, Mo.

[21] Appl. No.: 252,341

[22] Filed: Apr. 9, 1981

[51] Int. Cl.[3] ..... B65B 31/00; B67C 3/06

[52] U.S. Cl. ..... 141/39; 141/303; 141/367

[58] Field of Search ..... 141/37, 39, 40, 49, 141/52, 53, 54, 57, 58, 59, 63, 192, 197, 198, 227, 302, 303, 286, 392, 305, 4, 5, 6, 7, 8, 367

[56] References Cited

U.S. PATENT DOCUMENTS

| | | | |
|---|---|---|---|
| 2,467,684 | 4/1949 | Meyer et al. . | |
| 2,597,943 | 5/1952 | Meyer . | |
| 2,847,043 | 8/1958 | Sommers | 141/305 |
| 3,018,804 | 1/1962 | Granier | 141/286 |
| 3,067,785 | 12/1962 | Meyer | 141/57 |
| 3,090,408 | 5/1963 | Naecker | 141/57 |
| 3,192,966 | 7/1965 | Breeback | 141/56 |
| 3,209,794 | 10/1965 | Granier | 141/46 |
| 3,834,428 | 9/1974 | Rademacher | 141/39 |

*Primary Examiner*—Houston S. Bell, Jr.
*Attorney, Agent, or Firm*—Gravely, Lieder & Woodruff

[57] ABSTRACT

A filling valve arrangement for a counter-pressure container filling apparatus in which the filling valve arrangement is mounted in a bottom outlet opening in the usual bowl which holds the liquid under gas pressure, and an extension on the filling valve supports a filling head to receive the neck of a container in operative position so that a gas vent control carried by the vent tube is located in the container to admit gas into the container and to vent gas from the container as liquid replaces the gas in a rapid exchange of liquid for the gas up to the desired liquid level. The filling valve arrangement provides a space adjacent the liquid admitting valve for retaining a body of liquid in position for immediate admission in a very short period of time, and the gas vent control provides a device that can be snap-fitted onto many of prior types of vent tubes, but which is especially adapted to permit a range of weight adjustments to improve the positive response to the cut-off of the liquid fill as the gas is expelled from the container.

15 Claims, 4 Drawing Figures

FILLING VALVE ARRANGEMENT FOR COUNTER-PRESSURE CONTAINER FILLING APPARATUS

BACKGROUND OF THE INVENTION

1. Field of the Invention

This invention relates filling valve arrangements for container filling apparatus in which a pressurized liquid containing bowl is provided with multiple filling valves which are substantially self-contained and individually mounted on the bowl.

2. Description of the Prior Art

In traditional ball check mechanisms, as liquid hits the ball during the container filling cycle, the ball moves to a seated position at the end of the gas vent tube to effectively close the opening through which the gas is delivered into and vented from the container. In some instances the outflow of gas caused by the incoming liquid creates a venturi effect and occasionally the ball is sucked up prematurely, thus defeating the purpose for the valve. Normally the ball is gravity influenced to open the gas vent tube until it is lifted by the liquid admitted to the container.

There are a number of patents granted on container filling control valve arrangements in which a ball check has been incorporated. These included Meyer U.S. Pat. Nos. 3,067,785 of Dec. 11, 1962; Naecker 3,090,408 of May 21, 1963; and Breeback 3,192,966 of July 6, 1965. In addition there are a number of patents on the arrangement of the liquid flow passages and control thereover, such as Meyer, et al U.S. Pat. Nos. 2,467,684 of Apr. 19, 1949; Meyer 2,597,943 of May 27, 1952; and Rademacher 3,834,428 of Sept. 10, 1974.

Other prior art related to container filler mechanism with gas vent tubes include Sommers U.S. Pat. Nos. 2,847,043 of Aug. 12, 1958; Granier 3,018,804 of Jan. 30, 1962; and Granier 3,209,794 of Oct. 5, 1965. In these examples the gas vent tubes are not provided with liquid check valves as the emphasis appears to be placed on the operation of the counter-pressure valve for controlling the admission and shut-off of liquid flow into a container in association with valve operating mechanism disposed in the bowl holding the liquid and gas.

The foregoing known prior art present examples of filler apparatus having short gas vent tubes, operating mechanism located within the pressurized bowl for the liquid, and liquid flow passages which are prone to generate great turbulence during the liquid transfer under pressure. A further problem with the known prior art examples is the pressure loss associated with the form of the flow passages due to high friction, all of which significantly reduces the filling time. It is also a problem with known devices that a certain amount of liquid which enters the gas vent tube is blown out into the next container, and foaming results. While ball check elements are intended for preventing the entrance of liquid into the vent tubes while the gas is escaping, they do not achieve a smooth escape of the gas so that container filling time is slowed down, and there is a residue of liquid in the tube which, on the next filling cycle gets blown into the container, or it must be blown out which allows fine droplets of the liquid to penetrate the ambient areas.

Moreover, a ball type check valve presents a problem of adapting its weight to the desired valve. Balls are not easily made hollow to adjust weight, they cannot be formed with an open hole as the position of the hole cannot be controlled, and changing the ball size is not practical for weight selection as the means for caging the ball must also be changed to receive the ball. Changing materials also proves to be a problem because changing density solves only one problem and corrosion resistance from product and standard cleaning solutions presents another.

SUMMARY OF THE INVENTION

The present invention has as its objects to provide a filling valve arrangement mounted below the liquid bowl to provide a longer head than is found in current prior apparatus, and to construct the components such that the liquid passages are substantially free of turbulence creating areas.

It is a further object of this invention to provide the gas vent tube with a liquid check device which can be weighted as desired to match the gas exhaust venturi effect, and with a retainer for the check device which can be adapted for use with existing gas vent tubes.

Other objects are to provide a check device which incorporates a shaped element positioned by gravity to open a gas entrance and vent passage for obtaining rapid transfer of gas, and thereby greatly improved flow characteristics.

The preferred embodiments of the present invention are found in the provision of a long head reach between the liquid bowl and the gas vent tube which enters the container with liquid flow passages substantially free of areas which can cause flow retarding turbulence, and in the provision of a gas tube check device which is fitted over the tube and contains a check element shaped to have the desired weight factor for the characteristics of the liquid being delivered into the container, and to assure the rapid venting of the gas with minimum turbulence and foaming of the liquid.

BRIEF DESCRIPTION OF THE DRAWINGS

The preferred embodiments of the present invention are illustrated in the following views which form a part of this application, and in which.

DETAILED DESCRIPTION OF THE EMBODIMENTS

Figure 1:
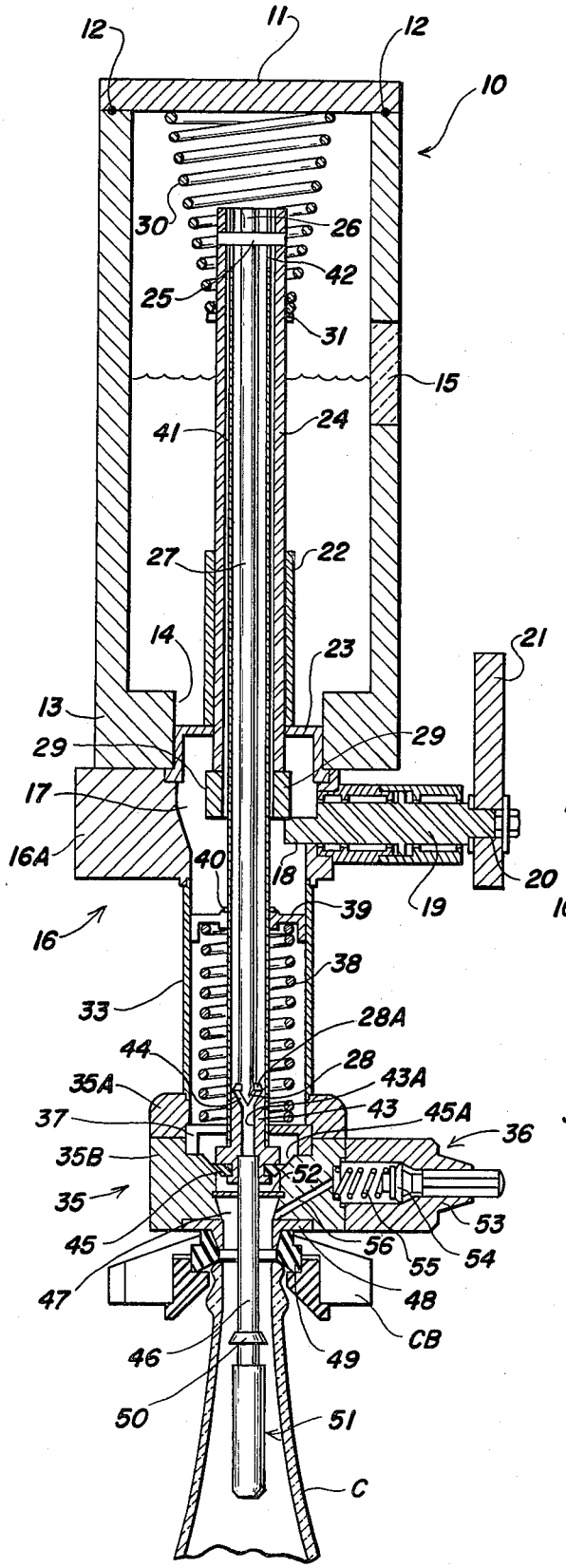
FIG. 1 is a vertical sectional view of a typical filling valve arrangement for a counter-pressure container filling apparatus in which the operating components are shown in position prior to the admission of the liquid.

In FIG. 1, the present embodiment, while shown in its normal no liquid flow condition, comprises a bowl 10 having a top closure 11 sealed by elements 12. The bottom wall 13 of the bowl is formed with an outlet opening 14. A sight glass 15 is mounted in the bowl wall so the level of the liquid may be checked as found necessary. The space above the liquid level is pressurized with a suitable gas, such as carbon dioxide or carbon dioxide and air mixture.

The filling valve assembly 16 arrangement comprises a base 16*a* secured over the outlet opening 14 in the bowl 10. The base 16*a* has a liquid passage 17 therein, and at one side of that passage an operating cam 18 is located. The cam 18 is carried by a shaft 19 having suitable seals, and the exterior end 20 is engaged by a lever 21 which moves with the rotation of the bowl 10 and is suitably actuated to cause the cam 18 to operate for the purpose of controlling the admission of the pressurizing gas to a container, as will presently appear.

The valve assembly 16 includes a guide 22 supported on a spider ring 23 projecting from the base 16*a* into the bottom outlet opening 14 such that the guide 22 projects into the body of liquid in the bowl 10. An outer or primary sleeve 24 is mounted in the guide 22 so its lower end reaches into the space adjacent the support spider 23. The outer or upper end of the primary sleeve extends above the level of the liquid in the bowl 10 so its open end is exposed to the pressurizing gas. The primary sleeve 24 supports a pin 25 which engages in the adjacent upper end 26 of a rod 27 suspended by the pin 25 inside the primary sleeve 24. The rod passes well below the bottom of the primary sleeve 24 to a bottom end in the form of a shaped valve 28, the purpose of which will be explained presently.

The base 16*a* supports a fork element having tines 29 straddling the rod 27 so as to engage the bottom end of the primary sleeve 24. One of the tines 29 also engages on the cam 18 for the purpose of being able to actuate the fork element so the primary sleeve 24 can be elevated. Rather than rely on gravity to hold the primary sleeve engaged on the fork tines 29, there is a spring 30 in the upper area of the bowl 10 engaged at one end on an abutment 31 fixed to the primary sleeve 24 and engaged on the under side of the cover 11 at its opposite end. Thus the reciprocation of the primary sleeve 24 in the guide 22 is effected by the cam 18 and the spring 30. During reciprocating movement of the primary sleeve 24, the rod 27 will be moved in like manner.

The base 16*a* secured to the bottom outlet 14 of the bowl 10 supports an extension member 33 and the lower end of the member 33 supports the upper part 35*a* of a container filling head 35. These parts 16*a*, 33 and 35*a* are welded or otherwise secured together as a subassembly. As shown the filling head 35 includes a second part 35*b* which is separate so a number of functional elements located internally of the head may be assembled. Snift valve 36 is supported by part 35*b*. The part 35*a* is counterbored to receive a spider element 37 which acts as an abutment for the lower end of a spring 38, the upper end of the spring being engaged on a second spider element 39 which is slidable in the extension 33. The upper end spider element 39 is secured by a suitable ring element 40 to the exterior of an elongated secondary sleeve 41. The secondary sleeve 41 has slots 42 therein which straddle the pin 25 connecting the rod end 26 to the primary sleeve 24 so the secondary sleeve 41 has movement independent of the primary sleeve 24.

The bottom end of the secondary sleeve 41 supports a body 43 which may be press-fitted in the sleeve 41 such that its inner conic end forms a seat surface 44 to receive the shaped valve 28 on the rod 27. A valve seal ring 28*a* is carried by the valve 28 so as to close the passage 43*a* in the body 43. The bottom end of the body 43 is enlarged so it can support a suitable valve ring 45 in position to engage on the bevelled seat 45*a* formed in the part 35*b* of the filler head 35. The body 43 supports the upper end of a gas vent tube 46 in position to extend through the passage 47 and through a support nipple 48 for a resilient ring 49 which is engaged by any finish of a container C. The outer end of the vent tube carries a liquid spreader element 40 above a vent control valve assembly 51. A suitable screen 52 may be supported in the passage 47 below the seat surface 45*a*. A conventional centering bell C.B. is used to position and locate the container in proper relation to the valve assembly 51.

The snifter valve 36 includes a valve body 53 for a valve 54 which is pressed into normal closed position by resilient element 55. The cavity in the body 53 is in communication through a passage 56 with the passage 47, and upon pressing on the valve rod 57, the passage 47 is opened to ambient space as the valve 54 is unseated.

Figure 3:
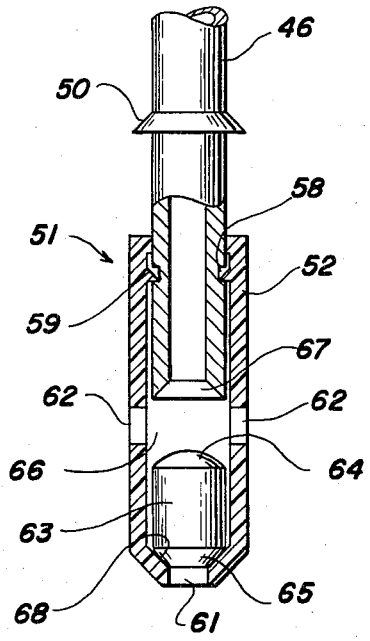
FIG. 3 is a fragmentary sectional view of the gas vent tube and check device carried thereon, the view showing the check device in position during the admission of the gas into a container.
Figure 4:
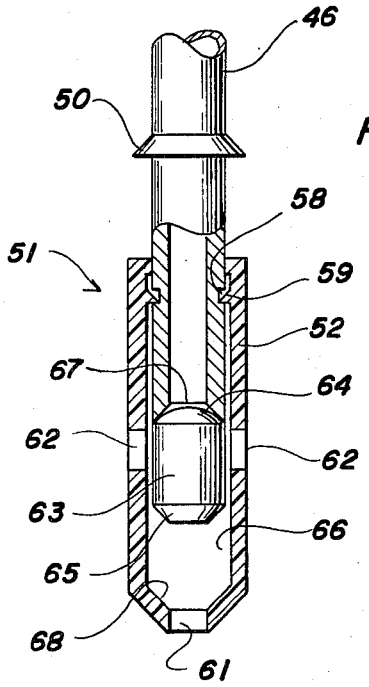
FIG. 4 is a view similar to the view of FIG. 3 but with the check device in its gas vent tube closed position.

In FIG. 3, the vent tube valve assembly 51 comprises a tubular body 52 slidably received over the end of the vent tube 46 below the spreader 50. The tube 46 is formed with a groove or indentation 58 shaped to be engaged by a projection 59 inside the body 52. It is preferred that the body 52 be formed from resilient material or its equivalent so as to achieve the snap-fit securement desired at the indentation 58 for the projection 59. The body 52 extends below the end of the vent tube to provide a cavity 66 which is open at the bottom at 61 and is open at cross aligned apertures 62. The cavity 60 houses a piston element 63 in the form of a cylindrical bullet having a blunt-rounded end 64 and a chamferred or shaped base 65 to nate with a shaped seat 68 surrounding the opening 61 to receive the base 65. The blunt-rounded end 64 is adapted to seat in a bevel surface 67 in the end of the vent tube 46.

Figure 2:
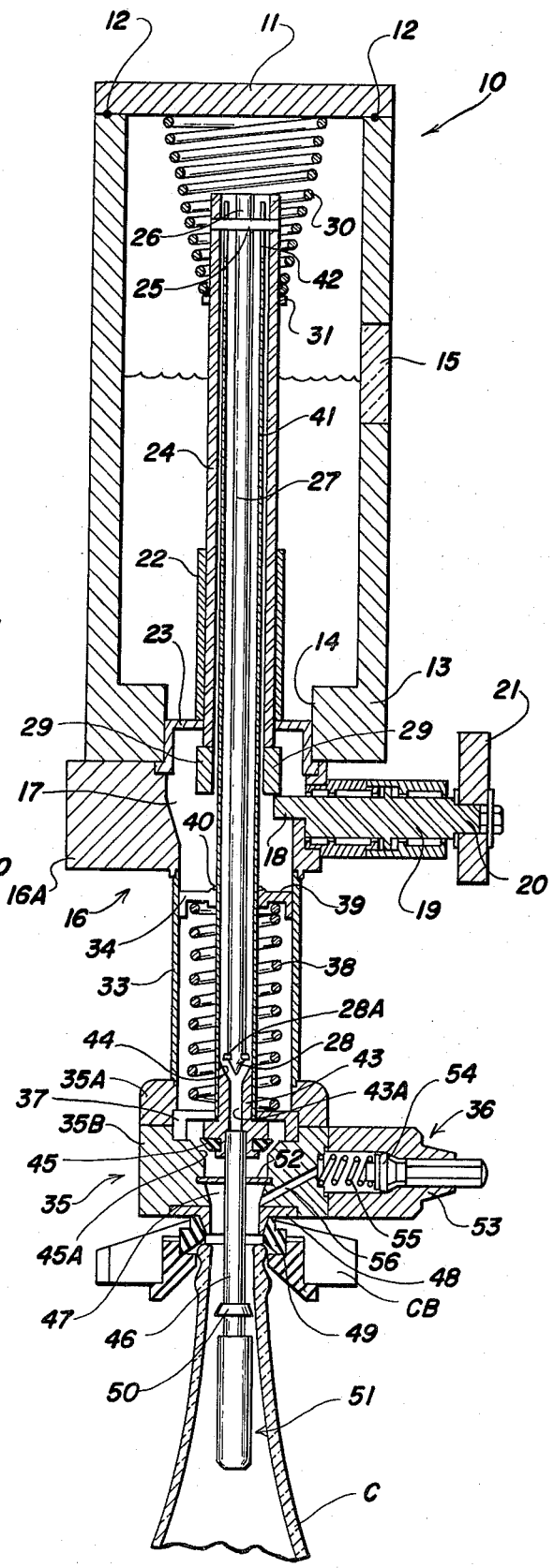
FIG. 2 is a view similar to FIG. 1, but showing the components operated to position for admitting the liquid.

Comparing FIGS. 1 and 2, it can be seen that when the lever 21 is actuated to rotate cam 18 and raise the primary sleeve 24, the rod 27 is raised and its valve end 28 is lifted off the seat 44 in body 43 at the end of the secondary sleeve. The gas in the space above the liquid in bowl 10 is released to flow through the secondary sleeve 41 and through the vent tube 46 and the vent control valve assembly 51 into the container C. During this time, and even before, liquid is forced to fill the extension 33 above the control valve 45. When the pressure condition in the container C is equal to the pressure of the liquid at the valve 45, the resilient spring 38 is able to lift the spider 39 and raise the secondary sleeve 41. The raising of the latter sleeve 41 lifts the valve 45 off seat 45*a* and liquid is released to flow by gravity from the bowl 10 into the container C. As the liquid rises in container C, the gas is displaced and returns upwardly through the vent tube 46. The exchange of liquid for the gas in the container C occurs very rapidly which is desirable to shorten the time required to fill a container.

The present embodiment is constructed with the extension 33 of a size to retain above the valve 45 a quantity of liquid substantially equal to that needed to fill a container. That liquid is pressurized in view of it being directly in communication through passage 17 in the base 16 with the bottom outlet 14 in the bowl 10. The liquid flow passage from the bowl 10 to the valve 45 is substantially clear of elements which increase turbulence when flow occurs. The exceptions are the arms on the respective spider elements 23, 37 and 39. Below the position of valve 45, the flow passage is defined by the bevelled seat 45*a* and the smooth passage 47 to and through the nipple 48 which is open to the interior of the container. As the liquid passes the nipple it is spread uniformly by the spreader 50 on the vent tube 46 and follows the contour of the container wall so as not to oppose the counter flow of the gas.

Turning to FIG. 3, the lower end of the vent tube 46 carries the vent control valve assembly 51 which, during gas flow into the container, has its apertures 62 open and the piston element 63 positioned by gravity so its shaped end 65 is engaged on the seat 68. Now when the gas is displaced rapidly by liquid entering the container, the assembly reacts by the weight of the piston retaining the bottom aperture 61 closed while the gas flows back through the apertures 62 and smoothly into the bevelled entrance 67 of the vent tube 46. The gas flow is rapid and creates a venturi effect in the upper area of the cavity 66. However, the piston 63 is not long enough to feel the venturi effect on its blunt-rounded end 64 and remains free of the apertures 62. However, as the liquid rises it enters the aperture 61 and tends to lift the piston 63 to a position where the venturi effect of the gas flow will pick up the piston and move it into a position engaged on the bevelled seat 67 to stop further gas venting. When in the raised position the differential pressure holds the piston in raised position. The liquid will continue to rise until the pressure in the neck area equals the pressure acting on the liquid from the bowl. The pressure creates surface tension on the liquid on the screen and stops flow by balancing the liquid on the screen. At the proper time, lever 21 will be operated to rotate cam 18 so the spring 30 can lower the primary sleeve and thereby return the rod 27 so its lower end 28 engages seat 44 in body 43 to close the gas passage through the secondary sleeve 41. When this occurs, the pressurized liquid in the extension will force the valve 45 to engage its seat 45*a*. The final step is for the snifter valve 36 to be actuated to open the passage 56 to the ambient area and allow escape of the small quantity of gas which has been trapped in the container neck, and the area of the vent tube under the gas seat 44 until the pressure is reduced to atmospheric level.

What has been described above is an improved container filling assembly which is constructed so it can be bench tested for operability prior to being attached to the usual bowl of a container filling apparatus. The important characteristics include making the assembly longer by mounting the filling head 35 at a greater distance from the bowl so the longer construction will contain a quantity of liquid sufficient to substantially fill a container in a position and under bowl pressure to be immediately releasible to flow quickly into a container with a minimum of turbulence. The result is that container filling time is reduced by the higher head pressure than is available in older or known existing apparatus.

The foregoing invention also includes the vent control valve assembly 51 which can be mounted on existing filling apparatus having gas vent tubes, as well as combined in the snap-fit manner when used with the improved filling assembly herein. It has been substantially varified by tests that the assembly 51 performs in an exceptional manner when constructed in the size which has been tested. For example, the body 52 had an internal diameter of 6 mm, a bottom opening 61 of 3 mm, and apertures 62 of 3 mm. The piston element was formed of stainless steel to a diameter of 5.8 to 5.9 mm and with a constant diameter body length of about 9 mm such that the shaped portion 65 added about 2 mm to the length and the blunt-rounded head 64 added an additional 1 mm to the overall length. Thus, the cross-sectional area of the cavity 66 is substantially larger than the cross-sectional area of the internal passage of the vent tube 46. The position of the blunt-rounded head 64 about 3 mm below the bevelled end 67 of the vent tube 46 provides a short stroke motion of the piston without restricting the apertures 62 as to area for gas escape. The piston configuration is important as it can be weight modified in several ways as required by the character of the liquid and by the desired responsive movement when it is moved into the venturi effect of the gas flow through the vent tube 46 back to the bowl 10. For example, the piston 63 can be formed of a material which adapts to weight modification as well as length changes to suit the required characteristics of the individual application to a filling apparatus. Changes in density of material or length, or size are factors which are easily calculated, and which are not so easily attained when confronted with a ball type valve. Whiel dimensions are given for a test assembly, it is to be understood that changes in enlarging or reducing the size of the assembly should stay within ratios which the above dimensions have generally established.

When employed to fill containers with potable liquids, the foregoing components of the apparatus should be formed of stainless steel or a suitable non-corrosive material which has no influence on taste or on other aspects of the liquid.

What is claimed is:

1. In counter-pressure container filling apparatus having a liquid containing bowl with a pressure exerting gas on the liquid therein, the improvement of: a filling head containing a liquid admitting control valve; a bowl extension interconnecting said filling head and said bowl for conducting the liquid to said control valve; a gas passage means extending from an open end in the gas in said bowl through said bowl extension to an opposite end position adjacent said control valve; passage means extending through said control valve; a second control valve positioned between said gas passage and passage means for controlling the flow of gas through said control valve; means on said filling head in alignment with said passage means for sealing about the entrance mouth of a container; a gas vent tube extending from said passage means beyond said sealing means for penetrating into a container for regulating the liquid filling level; first operating means adjacent said bowl for opening and closing said second control valve to control the admission of gas under pressure into a container and establish a counter pressure on said control valve substantially equal to the gas pressure in the bowl exerted on said control valve; and means operably connected to said control valve for opening said valve to admit the liquid from the bowl to a container and for displacing the gas back through said gas vent tube to the bowl upon substantial equalization of pressure across said control valve, the liquid displacing the gas in a container to a level determined by the liquid reaching said gas vent tube.

2. The improvement set forth in claim 1 wherein said bowl extension being sized to retain a quantity of liquid substantially equal to the volume of a container to be filled, said retained quantity of liquid being under pressure exerted by the gas acting on the liquid in the bowl, and being adjacent said control valve for ready release to a container upon opening of said control valve.

3. The improvement set forth in claim 1 wherein said opposite end of said gas passage supports a body carrying said control valve and a valve seat; said filling head having a seat presented to said control valve; and said body havng a valve seat presented to said second control valve.

4. The improvement set forth in claim 1 wherein said means operably connected to said control valve is rendered operable to move said control valve off said seat carried by said filling head, and to move said gas passage means.

5. The improvement set forth in claim 1 wherein a vent control is mounted on said gas vent tube, said vent control having a body engaged over the end of said vent tube and providing a cavity formed with a gas flow aperture adjacent said vent tube and an opening remote from said vent tube; and piston means movable in said cavity from a position closing said remote opening to a position closing said vent tube end.

6. A filling valve arrangement for counterpressure container filling apparatus in which a bowl for holding a liquid under pressure from a gas for delivery to a container is provided with a bottom outlet, said filling valve comprising:

(A) a base positioned in the bottom outlet of the bowl and supporting a movable primary sleeve projecting into the bowl to position with its end above the liquid level;

(B) a tubular extension depending from said base and communicating with the bowl through said base for receiving liquid from the bowl;

(C) a filling head connected to said tubular extension and formed with a valve seat and a flow passage extending outwardly from said valve seat;

(D) a secondary sleeve disposed inside said primary sleeve and extending from an open end above the liquid level in the bowl to an opposite end adjacent said valve seat, said secondary sleeve carrying a body at its opposite end which is carrying a valve element in position to cooperate with said valve seat, and said body being formed with a second valve seat;

(E) resilient means operably disposed in said tubular extension and connected to said secondary sleeve in position for moving said valve element off said valve seat in said filling head; said resilient means being normally opposed by the liquid under gas pressure in said tubular extension and the liquid head from the bowl;

(F) gas flow control means disposed in said secondary sleeve and extending from one end operatively connected to said primary sleeve to a valve end cooperating with said second valve seat, said gas flow control means being movable with said primary sleeve and independent of said secondary sleeve;

(G) operating means in said base in position for initiating movement of said primary sleeve in a direction to move said gas flow control means for opening said second valve seat to release gas therethrough;

(H) and a gas vent tube connected to said body carried by said secondary sleeve, said vent tube extended through said filling head flow passage and to a position therebeyond for entering a container to receive the liquid.

7. The filling valve arrangement set forth in claim 6 wherein said tubular extension depending from said base is sized to contain a quantity of liquid approaching the volume of liquid to be delivered to a container.

8. The filling valve arrangement set forth in claim 6 wherein said base is detachable from the bowl bottom outlet, and said primary and secondary sleeves project from said base into the bowl and are removable with detachment of said base.

9. The filling valve arrangement set forth in claim 6 wherein a gas flow control is carried on said gas vent tube at the end thereof entering a container, said flow control comprising a body fitted over the vent tube end and formed with a cavity having a gas flow opening adjacent said vent tube end and an opening remote from said vent tube end, and piston means movably carried in said cavity in position to move from a position closing said remote opening to a position closing said vent tube end.

10. In a liquid filling head for a counter-pressure container filling apparatus having a gas vent tube projecting beyond said filling head for penetrating into a container, the improvement which comprises: a body fitted onto the gas vent tube and providing a cavity beyond the end of said gas vent tube which is formed with a gas flow opening adjacent the end of said gas vent tube and an aperture remote from said gas flow opening; and a piston element movably carried in said cavity for closing said remote aperture upon gas flow into a container and responsive to liquid reaching said piston through said remote aperture for movement to close the end of said gas vent tube to the escape of gas through said gas vent tube.

11. The improvement set forth in claim 10 wherein said cavity is formed as a cylinder; said piston element is formed as an elongated cylinder slidably contained in said cavity and having a first end adapted to seat on said remote aperture and having a second end adapted to seat on said gas vent tube end, said piston element being formed of a material to be substantially inert to the liquid and gas, having a weight factor substantially coordinated to the characteristics of the liquid, and a length relative to said cylindrical cavity to be substantially free of imposing an impediment to gas flow through said gas flow openings.

12. The improvement set forth in claim 11 wherein said piston element first end is shaped and said second end is formed as a blunt-rounded surface.

13. The improvement set forth in claim 10 wherein said body is formed of a resilient material and provided with projection means and the gas vent tube is formed with cooperating means for receiving said projecting means in a snap together fit.

14. The improvement set forth in claim 10 wherein said body fitted on the gas vent tube and the vent tube have cooperative means adapted to interfit for retaining said body in position on the gas vent tube.

15. The improvement set forth in claim 10 wherein said gas flow opening in said body comprises at least one aperture and said piston element is formed with a body substantially filling said cavity below said at least one aperture for directing the gas flow into and out of said vent tube through said at least one aperture, said gas flow into said vent tube upon liquid reaching said piston element and raising said piston element creates a venturi effect for completing the raising of said piston element to a position closing the gas vent tube.

* * * * *